US006406072B1

(12) United States Patent
Chen

(10) Patent No.: US 6,406,072 B1
(45) Date of Patent: Jun. 18, 2002

(54) DRIVE DEVICE FOR AN ELECTRICALLY OPERATED LOCK

(75) Inventor: Po-Yang Chen, Chia-Yi (TW)

(73) Assignee: Tong-Lung Metal Industry Co., Ltd., Chia-Yi (TW)

( * ) Notice: Subject to any disclaimer, the term of this patent is extended or adjusted under 35 U.S.C. 154(b) by 42 days.

(21) Appl. No.: 09/696,419

(22) Filed: Oct. 25, 2000

(30) Foreign Application Priority Data

Oct. 26, 1999 (TW) ..... 088218272 U

(51) Int. Cl.[7] ..... E05C 1/06

(52) U.S. Cl. ..... 292/144; 292/142; 70/275; 70/277

(58) Field of Search ..... 292/39, 144, 142, 292/336.3; 70/275, 277

(56) References Cited

U.S. PATENT DOCUMENTS 5,857,365 A 1/1999 Armstrong
6,012,310 A * 1/2000 Hsiao ..... 292/144 X
6,062,612 A * 5/2000 Lin ..... 292/144
6,334,636 B1 * 1/2002 Huang et al. ..... 292/144

* cited by examiner

*Primary Examiner*—Teri Pham Luu
(74) *Attorney, Agent, or Firm*—Ladas & Parry

(57) ABSTRACT

An electrically operated drive device includes a wheel gear rotatably mounted on a spindle of a turning lever of a door lock. The wheel gear is driven by a motor, and has a cam member disposed thereon. A crank member has a crankshaft mounted on and rotatable with the spindle, and a crank pin. A shifting mechanism is disposed between the wheel gear and the crank member, and includes front and rear major walls that cooperate respectively with the crank member and the cam member to permit right and left displacement of the shifting member to thereby bring a deadbolt to one of retracted and extended positions.

8 Claims, 3 Drawing Sheets

DRIVE DEVICE FOR AN ELECTRICALLY OPERATED LOCK

BACKGROUND OF THE INVENTION

1. Field of the Invention

The invention relates to an electrically operated drive device adapted for driving a latch-actuating spindle of an electrically operable lock, more particularly to an electrically operated drive device that permits both manual and automatic actuation of the spindle of the lock.

2. Description of the Related Art

As door locks serve to protect the users' safety and properties from burglars, the design of door locks is focused on easy operation and difficult accessibility to burglars. Conventional door locks are mostly operable mechanically by the use of keys, which is quite inconvenient. Therefore, electrically operated locks have been developed. However, most electrically operated locks cannot be opened once the power supply thereto is exhausted or interrupted.

SUMMARY OF THE INVENTION

Therefore, the main object of the present invention is to provide an electrically operated drive device adapted for driving a latch-actuating spindle of an electrically operable lock, which enables the lock to be actuated both manually and automatically.

Accordingly, an electrically operated drive device of this invention is adapted for driving a latch-actuating spindle of an electrically operable lock. The lock includes a deadbolt, a coupling member, a mounting frame, and a spindle. The deadbolt is adapted to be mounted in a door, and is movable between a retracted position and an extended position. The coupling member includes a connecting end connected to the deadbolt, and an actuated end disposed distal to the deadbolt. The mounting frame has a rear wall, and is adapted to be mounted on an interior of the door. The spindle defines an axis, and includes proximate and distal portions opposite to each other in an axial direction parallel to the axis, and an intermediate portion interposed between the proximate and distal portions. The intermediate portion is disposed such that the proximate portion is rotatably mounted in and extends outwardly and rearwardly of the rear wall to form a manually operated grip end, and such that the distal portion is turnable about the axis from a first position to a second position which is angularly spaced apart from the first position, thereby imparting a force to the actuated end of the coupling member to place the deadbolt in one of the retracted and extended positions. The electrically operated drive device includes a motor, a wheel gear, a drive transmitting member, a linearly shifting member, a crank member, a first cam mechanism, and a second cam mechanism. The motor has an output shaft and is adapted to be activated by an electric signal. The wheel gear has an inner annular surface defining a central hole, a toothed rim portion perimetrically opposite to the inner annular surface, and an annular major wall interposed between the inner annular surface and the toothed rim portion. The inner annular surface is adapted to be rotatably mounted on the intermediate portion and adjacent to the proximate portion. The drive transmitting member is disposed to transmit drive of the output shaft to the toothed rim portion so as to rotate the wheel gear. The shifting member includes first front and rear major walls opposite to each other, and is adapted to be loosely mounted on the intermediate portion so as to have the first rear major wall spaced apart from the annular major wall in the axial direction. The first front major wall defines a sliding slot which extends to be communicated with the first rear major wall. The sliding slot is elongated in a first direction transverse to the axial direction so as to define a transverse centerline that divides each of the first front and rear major walls into upper and lower halves, and a longitudinal centerline transverse to the transverse centerline so as to divide the sliding slot into right and left halves. The crank member includes a crankshaft adapted to be mounted coaxially on and to rotate with the intermediate portion, a crank web radially extending from the crankshaft and terminating at an anchoring end, and a crank pin extending from the anchoring end in the axial direction. The first cam mechanism includes a first cam member disposed on the annular major wall, and first upper and lower followers disposed respectively on the upper and lower halves of the first rear major wall of the shifting member. As such, when the first cam member rotates with the annular major wall to turn 180 degrees, the shifting member will move from one of rightmost and leftmost positions to the other one of the rightmost and leftmost positions in the first transverse direction. The second cam mechanism includes right and left translating cam surfaces and a second follower. The right and left translating cam surfaces are disposed on at least one of the upper and lower halves of the first front major wall of the shifting member, with a dead end juncture formed between the right and left translating cam surfaces. The dead end juncture cooperates with the right and left translating cam surfaces to establish a continuous sliding path such that the dead end juncture is moved from one of right and left positions to the other one of the right and left positions when the shifting member moves from a respective one of the rightmost and leftmost positions to the other one of the rightmost and leftmost positions. The second follower is disposed coaxially with the crank pin, and is retainingly slidable on the continuous sliding path such that when the second follower is brought to one of the right and left positions of the dead end juncture, the crankshaft will be turned to rotate with the intermediate portion of the spindle to a respective one of first and second positions.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figures 1, 6:
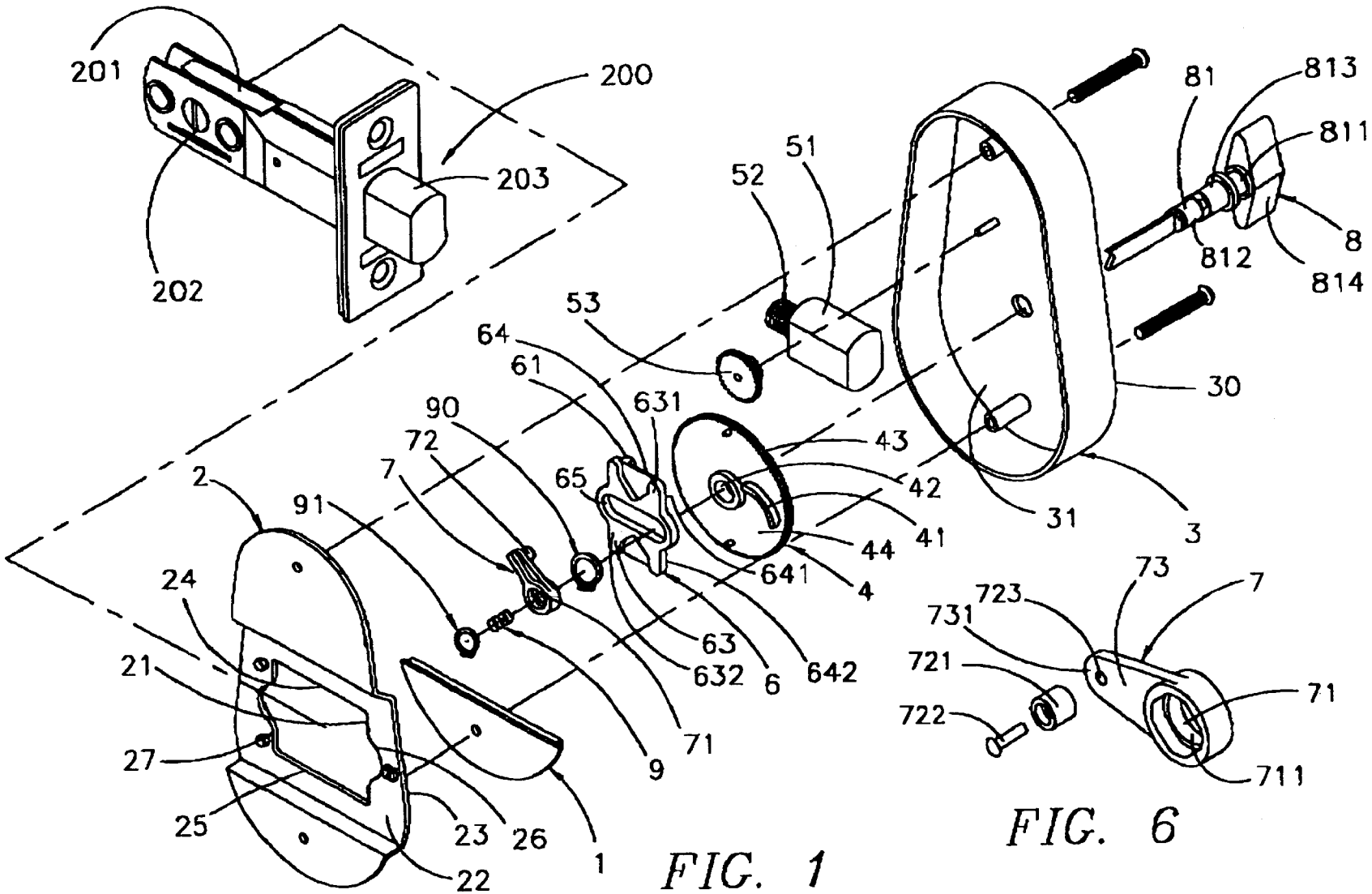
FIG. 1 is an exploded perspective view of the preferred embodiment of an electrically operated drive device according to the invention when adapted for use in an electrically operable lock.
FIG. 6 is an exploded perspective view illustrating a modified embodiment of a crank member of the drive device according to the invention.

Referring to FIG. 1, an electrically operated drive device of this invention is adapted for driving a latch-actuating spindle 81 of an electrically operable lock. The lock includes a mounting frame 3 for mounting a lock body, and a latch mechanism 200 for mounting in a door (not shown) and including a deadbolt 203 and a deadbolt actuating device 201, 202 that is actuated by the spindle 81 to move the deadbolt 203 between a retracted position and an extended position. The electrically operated drive device generally includes a motor 51, a rotatable wheel gear 4, a drive transmitting member 52, 53, a crank member 7, and a linearly shifting member 6. The wheel gear 4 is connected to the spindle 81 and has an eccentric cam member 41. The drive transmitting member 52, 53 is adapted to transmit rotation of the motor 51 to the wheel gear 4. The crank member 7 is mounted on and is coupled with the spindle 81 so as to rotate therewith, and includes a crank pin 72. The shifting member 6 is disposed between the wheel gear 4 and the crank member 7, and has rear and front walls 64, 63. The rear wall 64 is disposed proximate to the wheel gear 4, and is provided with two spaced-apart control surfaces. The control surfaces cooperate with the cam member 41 to cause the shifting member 6 to displace from one of rightmost and leftmost positions to the other one of the rightmost and leftmost positions when the wheel gear 4 is rotated. The front wall 63 is disposed-proximate to the crank member 7 and is provided with two spaced-apart control portions. The control portions cooperate with the crank pin 72 to rotate the crank member 7 and the spindle 81 when the shifting member 6 displaces from one of the rightmost and leftmost positions to the other one of the rightmost and leftmost positions so as to actuate the deadbolt 203 to move between the retracted and extended positions.

Specifically, referring to FIGS. 1 to 6, the preferred embodiment of an electrically operated drive device according to the present invention is adapted for driving a latch-actuating spindle 81 of an electrically operable lock which includes a deadbolt 203, a coupling member 201, a mounting frame 3, and a turning lever 8 having the spindle 81. The deadbolt 203 is adapted to be mounted in a door (not shown) and is movable between the retracted and extended positions. The coupling member 201 includes a connecting end connected to the deadbolt 203 and an actuated end 202 disposed distal to the deadbolt 203. The mounting frame 3 has a rear wall 30 and is adapted to be mounted on an interior of the door (not shown). The spindle 81 defines an axis, and includes proximate and distal portions 811, 812 opposite to each other in an axial direction parallel to the axis, and an intermediate portion 813 interposed between the proximate and distal portions 811, 812. The intermediate portion 813 is disposed to permit the proximate portion 811 to be rotatably mounted in and to extend outwardly and rearwardly of the rear wall 30 of the mounting frame 3 so as to form a manually operated grip end 814, and to permit the distal portion 812 to be turnable about the axis from a first position to a second position which is angularly spaced apart from the first position to thereby impart a force to the actuated end 202 so as to place the deadbolt 203 in one of the retracted and extended positions.

The drive device is coupled to a control device 1 that includes a control circuit (not shown) and a power supply device (not shown). As shown, the drive device includes a motor 51, a reduced speed gear mechanism, a linearly shifting member 6, a crank member 7, a first cam mechanism, and a second cam mechanism. The motor 51 has an output shaft 54, and is adapted to be activated by an electric signal generated by the control device 1.

The reduced speed gear mechanism includes a wheel gear 4 and a drive transmitting member that includes a worm 52 and a worm gear 53. The wheel gear 4 has an inner annular surface 42 defining a central hole, a toothed rim portion 43 perimetrically opposite to the inner annular surface 42, and an annular major wall 44 interposed between the inner annular surface 42 and the toothed rim portion 43. The inner annular surface 42 is adapted to be rotatably mounted on the intermediate portion 813 and adjacent to the proximate portion 811. The drive transmitting member is disposed to transmit the drive of the output shaft 54 to the toothed rim portion 43 80 as to rotate the wheel gear 4.

The shifting member 6 includes first front and rear major walls 63, 64 opposite to each other, and are adapted to be loosely mounted on the intermediate portion 813 so that the first rear major wall 64 is spaced apart from the annular major wall 44 in the axial direction. The first front major wall 63 defines a sliding slot 65 which extends to be communicated with the first rear major wall 64. The sliding slot 65 is elongated in a first direction transverse to the axial direction to define a transverse centerline that divides each of the first front and rear major walls 63, 64 into upper and lower halves 631, 632, 641, 642, and a longitudinal centerline which is transverse to the transverse centerline and which divides the sliding slot 65 into right and left halves.

The crank member 7 includes a crankshaft 71, a crank web 73, and a crank pin 72. The crankshaft 71 is adapted to be mounted coaxially on and to rotate with the intermediate portion 813 of the spindle 81. The crank web 73 extends radially from the crankshaft 71 and terminates at an anchoring end 731. The crank pin 72 extends from the anchoring end 731 in the axial direction. The crank web 73 includes an annular wall surface 711 extending in the axial direction, and the crankshaft 71 is disposed to be journalled on and axially movable relative to the annular wall surface 711. Alternatively, the crank pin 72 may be substituted by a roller 721 and a rivet 722 passing through the roller 721 and a pin hole 723 in the anchoring end 731 so as to rivet the roller 721 to the anchoring end 731 (see FIG. 6). Furthermore, a fastening ring 90 may be disposed to space the crankshaft 71 apart from the shifting member 6.

The first cam mechanism includes a first cam member 41 and first upper and lower followers 61. The first cam member 41 is disposed on the annular major wall 44 of the wheel gear 4. The first upper and lower followers 61 are disposed respectively on the upper and lower halves 641, 642 of the first rear major wall 64 of the shifting member 6, and are symmetrical relative to an intersecting point of the longitudinal and transverse centerlines. As such, when the first cam member 41 rotates with the annular major wall 44 to turn 180 degrees, the shifting member 6 will move from one of rightmost and leftmost positions to the other one of the rightmost and leftmost positions in the first transverse direction.

The second cam mechanism includes upper and lower sets of right and left translating cam surfaces 621, 622, 624, 625 (see FIG. 2), and a second follower 721. The upper and lower sets of the right and left translating cam surfaces 621, 622, 624, 625 are respectively disposed on the upper and lower halves 631, 632 of the first front major wall 63, with dead end junctures 623, 626 formed between the right and left translating cam surfaces 621, 622, 624, 625, respectively. The right and left translating cam surfaces 621, 622, 624, 625 of each of the upper and lower sets are symmetrical relative to the longitudinal centerline, and cooperate with the respective dead end junctures 623 to establish upper and lower continuous sliding paths, respectively, such that the respective dead end juncture 623 is moved from one of right and left positions to the other of the right and left positions when the shifting member 6 moves from one of the rightmost and leftmost positions to the other one of the rightmost and leftmost positions. The second follower 721 is disposed coaxially with the crank pin 72, and is retainingly slidable on one of the upper and lower continuous sliding paths such that when the second follower 721 is brought to one of the right and left positions (of the dead end juncture 623), the crankshaft 71 will be turned to rotate with the intermediate portion 813 of the spindle 81 to a respective one of first and second positions.

The drive device further includes a biasing member 9 disposed between the annular wall surface 711 and the crankshaft 71 to bias the second follower 721 towards the first front major wall 63 so as to ensure retainingly sliding movement of the second follower 721 on one of the continuous sliding paths.

The drive device further includes a guiding member 2 having second front and rear major walls 22, 23 opposite to each other in the axial direction. The guiding member 2 is adapted to be mounted on the mounting frame 3, and is spaced apart from the rear wall 30 in the axial direction so as to define a chamber 31 to accommodate the shifting member 6. The second front major wall 22 includes an inner peripheral wall 21, which extends to communicate the second front major wall 22 with the second rear major wall 23. The inner peripheral wall 21 includes upper and lower segments 24, 25 parallel to and spaced apart from each other in a longitudinal direction parallel to the longitudinal centerline such that the upper and lower halves 631, 632 of the first front major wall 63 are in sliding contact with the upper and lower segments 24, 25, respectively, when the shifting member 6 moves from one of the rightmost and leftmost positions to the other one of the rightmost and leftmost positions. The inner peripheral wall 21 further includes right and left lateral segments 26, 27 which are spaced apart form each other in the first transverse direction and which act as barriers to limit movement of the shifting member 6 when the shifting member 6 moves from one of the rightmost and leftmost positions to the other one of the rightmost and leftmost positions.

In a manual mode, when the spindle 81 is turned, the crankshaft 71 will rotate therewith from the first position (FIG. 4) to the second position (see FIG. 5) and the crank pin 72 will push the shifting member 6 to move from the rightmost position to the leftmost position. As such, turning of the turning lever 8 and hence the spindle 81 can drive the deadbolt 203 to the retracted or extended position.

Figure 2:
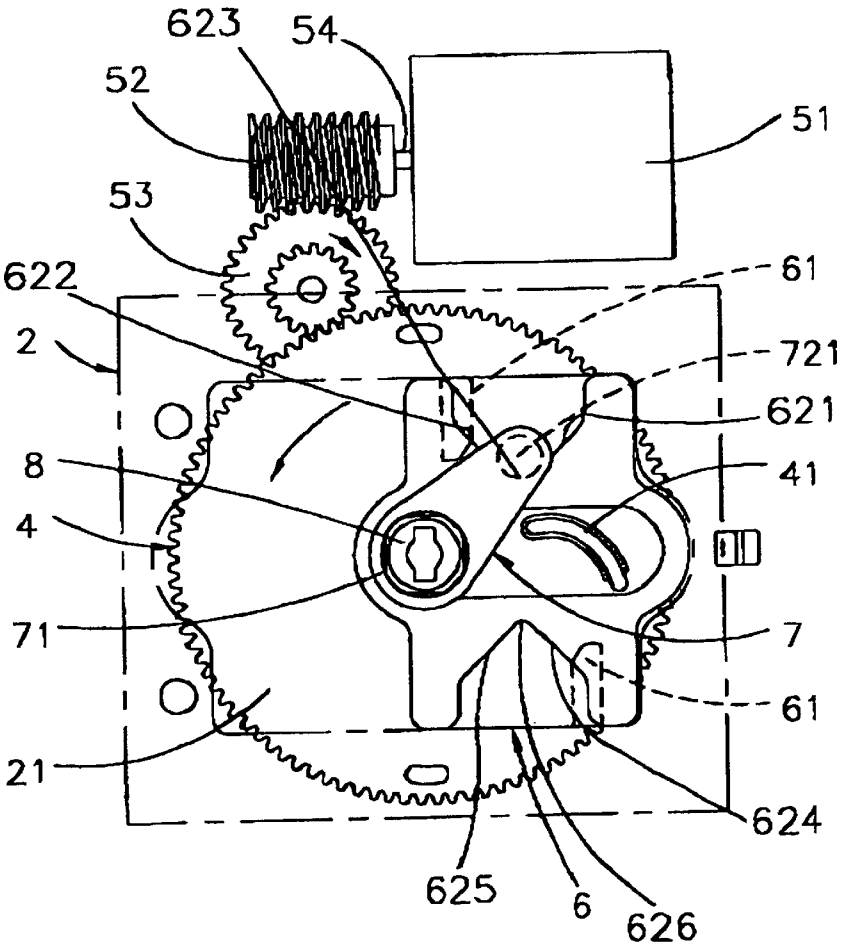
FIG. 2 is an elevation view illustrating a first cam member of preferred embodiment at a 0-degree position.
Figure 5:
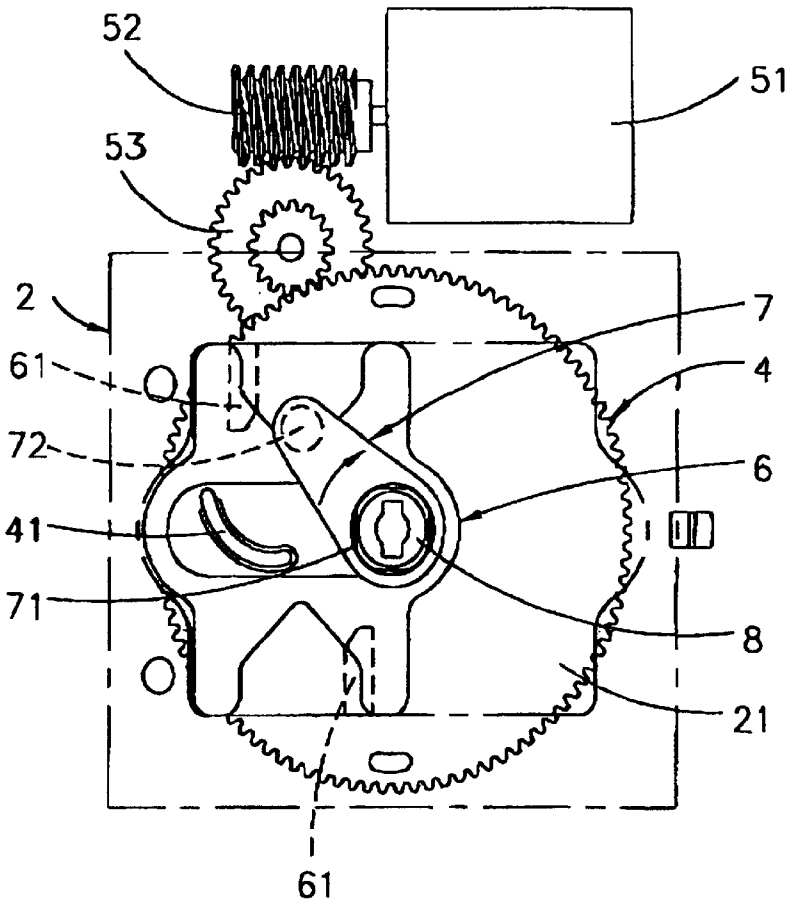
FIG. 5 is an elevation view illustrating the shifting member at a leftmost position.
Figure 4:
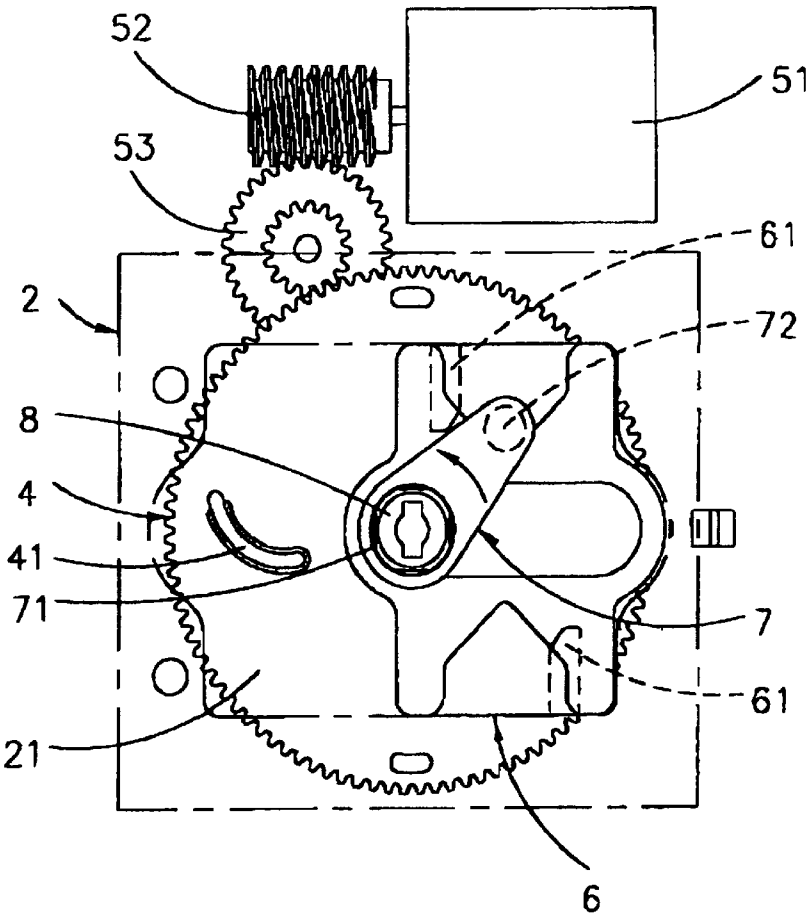
FIG. 4 is an elevation view illustrating a shifting member of the preferred embodiment at a rightmost position.

In an automatic mode, when the first cam member 41 is rotated with the annular major wall 44 to a 0-degree position, the shifting member 6 is at the rightmost position (see FIG. 2). At this time, the motor 51 will drive the wheel gear 4 so that the first cam member 41 pushes the first upper follower 61 on the first rear major wall 64 of the shifting member 6 to move the shifting member 6 from the rightmost position to the leftmost position (see FIG. 3), thereby bringing the crankshaft 71 and the spindle 81 to turn therewith and to place the deadbolt 203 in one of the retracted and extended positions.

Figure 3:
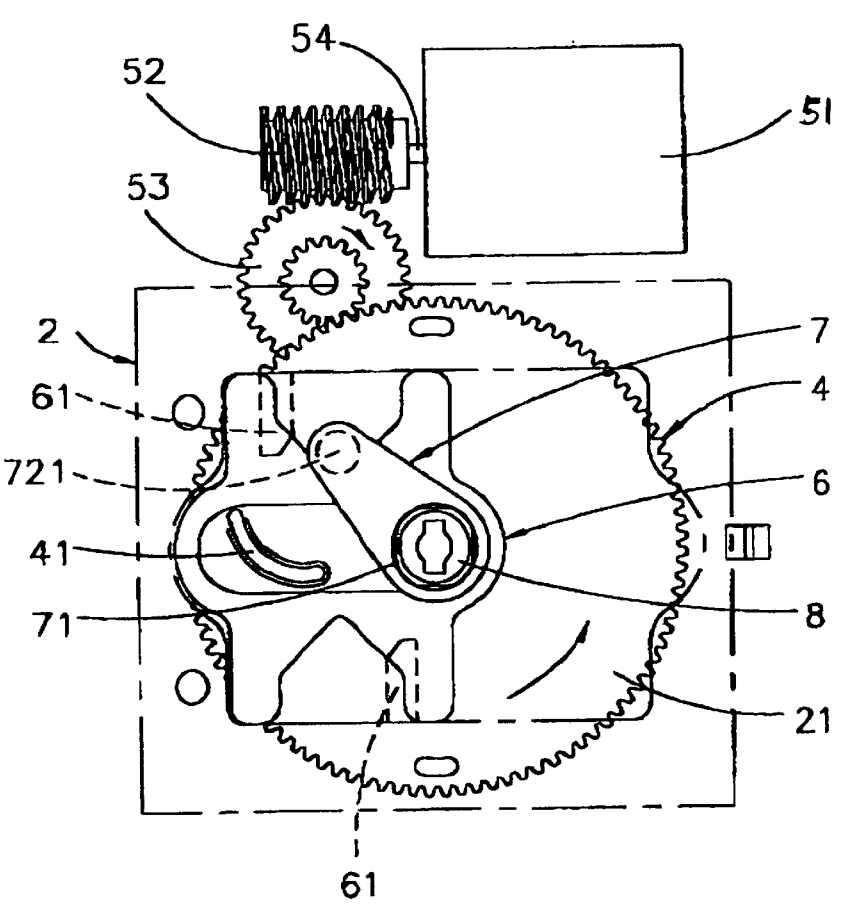
FIG. 3 is an elevation view illustrating the first cam member at a 180-degree position.

When the first cam member 41 is at the 180-degree position and the shifting member 6 is at the leftmost position, as shown in FIG. 3, the motor 51 will drive the wheel gear 4 so that the first cam member 41 pushes the first upper follower 61 to cause the shifting member 6 to displace to the rightmost position in FIG. 2. At this point, the first cam member 41 returns to the 0-degree position, and brings the crankshaft 71 and the spindle 81 to rotate therewith to thereby place the deadbolt 203 in the other of the retracted and extended positions.

It should be noted that the shifting member 6 is coupled to a micro-switch (not shown) so as to transmit signals to the control device 1 when located in either of the rightmost or leftmost positions. In addition, the crank member 7 may be selectively disposed to slide on either the upper continuous sliding path or the lower continuous sliding path so as to adapt to different positions of door locks.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An electrically operated drive device adapted for driving a latch-actuating spindle of an electrically operable lock that includes a deadbolt adapted to be mounted in a door and movable between a retracted position and an extended position, a coupling member including a connecting end connected the deadbolt, and an actuated end disposed distal to the deadbolt, a mounting frame with a rear wall and adapted to be mounted on an interior of the door, and a spindle defining an axis and including proximate and distal portions opposite to each other in an axial direction parallel to the axis, and an intermediate portion interposed between the proximate and distal portions, the intermediate portion being disposed such that the proximate portion is rotatably mounted in and extends outwardly and rearwardly of the rear wall to form a manually operated grip end, and such that the distal portion is turnable about the axis from a first position to a second position which is angularly spaced apart from the first position, thereby imparting a force to the actuated end of the coupling member to place the deadbolt in one of the retracted and extended positions, said electrically operated drive device comprising:

a motor with an output shaft and adapted to be activated by an electric signal;

a wheel gear which has an inner annular surface defining a central hole, a toothed rim portion perimetrically opposite to said inner annular surface, and an annular major wall interposed between said inner annular surface and said toothed rim portion, said inner annular surface being adapted to be rotatably mounted on the intermediate portion and adjacent to the proximate portion;

a drive transmitting member disposed to transmit drive of said output shaft to said toothed rim portion so as to rotate said wheel gear;

a linearly shifting member which includes first front and rear major walls opposite to each other, and adapted to be loosely mounted on the intermediate portion so as to have said first rear major wall spaced apart from said annular major wall in the axial direction, said first front major wall defining a sliding slot which extends to be communicated with said first rear major wall, said sliding slot being elongated in a first direction transverse to the axial direction so as to define a transverse centerline that divides each of said first front and rear major walls into upper and lower halves, and a longitudinal centerline transverse to said transverse centerline so as to divide said sliding slot into right and left halves;

a crank member including a crankshaft adapted to be mounted coaxially on and to rotate with the intermediate portion, a crank web radially extending from said crankshaft and terminating at an anchoring end, and a crank pin extending from said anchoring end in the axial direction;

a first cam mechanism including a first cam member disposed on said annular major wall, and first upper and lower followers disposed respectively on said upper and lower halves of said first rear major wall of said shifting member such that when said first cam member rotates with said annular major wall to turn 180 degree, said shifting member will move from one of rightmost and leftmost positions to the other one of the rightmost and leftmost positions in said first transverse direction; and a second cam mechanism including right and left translating cam surfaces disposed on at least one of said upper and lower halves of said first front major wall of said shifting member, with a dead end juncture formed between said right and left translating cam surfaces, said dead end juncture cooperating with said right and left translating cam surfaces to establish a continuous sliding path such that said dead end juncture is moved from one of right and left positions to the other one of the right and left positions when said shifting member moves from a respective one of the rightmost and leftmost positions to the other one of the rightmost and leftmost positions, said second cam mechanism further including, a second follower disposed coaxially with said crank pin and retainingly slidable on said continuous sliding path such that when said second follower is brought to one of said right and left positions of said dead end juncture, said crankshaft will be turned to rotate with the intermediate portion of the spindle to a respective one of first and second positions.

2. The electrically operated drive device according to claim 1, wherein said first upper and lower followers are symmetrical relative to an intersecting point of said longitudinal and transverse centerlines, and said right and left translating cam surfaces are symmetrical relative to said longitudinal centerline.

3. The electrically operated drive device according to claim 2, wherein said upper and lower halves of said first front major wall include an upper set of said right and left translating cam surfaces, and a lower set of said right and left translating cam surfaces, respectively, said upper set of said right and left translating cam surfaces and said lower set of said right and left translating cam surfaces cooperating with the respective dead end juncture to establish upper and lower ones of said continuous sliding paths, respectively.

4. The electrically operated drive device according to claim 3, wherein said crank web includes an annular wall surface extending in the axial direction, said crankshaft being disposed to be journalled on and axially movable relative to said annular wall surface, said electrically operated drive device further comprising a biasing member disposed between said annular wall surface and said crankshaft to bias said second follower towards said first front major wall so as to ensure retainingly sliding movement of said second follower on one of said continuous sliding paths.

5. The electrically operated drive device according to claim 1, further comprising a rivet to secure said crank pin to said anchoring end.

6. The electrically operated drive device according to claim 1, further comprising a guiding member having second front and rear major walls opposite to each other in the axial direction and adapted to be mounted on the mounting frame and spaced apart from the rear wall in the axial direction so as to define a chamber to accommodate said shifting member, said second front major wall including an inner peripheral wall extending to communicate said second front major wall with said second rear major wall, said inner peripheral wall including upper and lower segments parallel to and spaced apart from each other in a longitudinal direction parallel to said longitudinal centerline such that said upper and lower halves of said first front major wall are respectively in sliding contact with said upper and lower segments when said shifting member moves from one of the rightmost and leftmost positions to the other one of the rightmost and leftmost positions.

7. The electrically operated drive device according to claim 6, wherein said inner peripheral wall further includes right and left lateral segments which are spaced apart from each other in the first transverse direction and which serve as barriers to limit movement of said shifting member when said shifting member moves from one of the rightmost and leftmost positions to the other one of the rightmost and leftmost positions.

8. An electrically operated drive device adapted for driving a latch-actuating spindle of an electrically operable lock that includes a mounting frame for mounting a lock body, and a latch mechanism for mounting in a door and including a deadbolt and a deadbolt actuating device that is actuated by the spindle to move the deadbolt between a retracted position and an extended position, said electrically operated drive device comprising:

a motor;

a rotatable wheel gear connected to the spindle and having an eccentric cam member;

a drive transmitting member adapted to transmit rotation of said motor to said wheel gear;

a crank member mounted on and coupled with the spindle so as to rotate therewith, said crank member including a crank pin; and a linearly shifting member disposed between said wheel gear and said crank member and having rear and front walls, said rear wall being disposed proximate to said wheel gear and being provided with two spaced-apart control surfaces, said control surfaces cooperating with said cam member to cause said shifting member to displace from one of rightmost and leftmost positions to the other one of the rightmost and leftmost positions when said wheel gear is rotated, said front wall being disposed proximate to said crank member and being provided with two spaced-apart control portions, said control portions cooperating with said crank pin to rotate said crank member and the spindle when said shifting member displaces from one of the rightmost and leftmost positions to the other one of the rightmost and leftmost positions so as to actuate the deadbolt to move between the retracted and extended positions.

* * * * *